US005487681A

United States Patent [19]

Star et al.

[11] Patent Number: 5,487,681

[45] Date of Patent: Jan. 30, 1996

[54] PIN BNC COAXIAL CABLE CONNECTOR RECEPTACLE

[75] Inventors: Albert A. Star, Dix Hills; Anthony T. Carbone, Port Jefferson Station, both of N.Y.

[73] Assignee: Northrop Grumman Corporation, Los Angeles, Calif.

[21] Appl. No.: 296,024

[22] Filed: Aug. 25, 1994

[51] Int. Cl.[6] ..... H01R 9/07

[52] U.S. Cl. ..... 439/581; 439/63

[58] Field of Search ..... 439/63, 581, 645, 439/578, 585

[56] References Cited

U.S. PATENT DOCUMENTS

| | | | |
|---|---|---|---|
| 4,691,976 | 9/1987 | Cowen | 439/394 |
| 4,769,355 | 6/1988 | Hemmer | 439/63 |
| 5,090,915 | 2/1992 | Moulton | 439/188 |
| 5,137,469 | 8/1992 | Carpenter et al. | 439/578 |
| 5,185,570 | 2/1993 | Fitzpatrick | 324/133 |
| 5,192,216 | 3/1993 | Knauber et al. | 439/108 |
| 5,197,904 | 3/1993 | Gold | 439/581 |
| 5,246,384 | 9/1993 | Sato | 439/581 X |

FOREIGN PATENT DOCUMENTS

| | | | |
|---|---|---|---|
| 0405334 | 1/1991 | European Pat. Off. | 439/63 |
| 0809131 | 2/1959 | United Kingdom | 439/581 |

OTHER PUBLICATIONS

"Sealed External Printed Circuit Board Coax Cable" Research Disclosure, Jul. 1991, No. 327 Kenneth Mason Publications, Ltd. England.

*Primary Examiner*—David L. Pirlot

*Attorney, Agent, or Firm*—Terry J. Anderson; Karl J. Hoch, Jr.

[57] ABSTRACT

Electrical connectors, generally such as are employed for the transmission of signals, and more particularly, a modified or customized BNC coaxial cable connector of the female receptacle type, which is adapted to enable the direct connection thereof with a single-signal or mono-signal socket connector in the absence of any interfacing adapter. The modified BNC coaxial cable connector has a central contact post in the configuration of a square cross-section in lieu of the normal BNC cable connector solder cup, and whereby a further in parallel spaced therewith contact post of similar square cross-section is added to the encompassing ground ring at a predetermined radial spacing to the central contact post, so as to enable insertion of the two square posts into the respective therewith operative associated socket contacts of the mono-signal socket connector.

14 Claims, 2 Drawing Sheets

PIN BNC COAXIAL CABLE CONNECTOR RECEPTACLE

SUMMARY OF THE INVENTION

1. Field of the Invention

The present invention relates to electrical connectors, generally such as are employed for the transmission of signals, and more particularly, is directed to the provision of a modified or customized BNC coaxial cable connector of the female receptacle type, which is adapted to enable the direct connection thereof with a single-signal or mono-signal socket connector in the absence of any interfacing adapter.

The interconnection of BNC coaxial connectors; for example, especially female BNC coaxial connector receptacles which are mounted through the utilization of jam nuts as is known in the technology, and which are intended to operate for the transmission of radio frequencies, such as are designated under MIL-C-39012/21A or MIL-C-39012/22, in interconnection with so-called mono-signal or single-signal socket connectors, is ordinarily implemented through the use of an interface adapter located between the respective connectors. Generally, such female BNC coaxial cable connector receptacles each include a central contact post for the transmission of a signal and a cylindrical ground ring extending in spaced relationship thereabout which, when the BNC connector is required to be connected to a single-signal or mono-signal socket connector necessitates the interposition of a suitable adapter providing for an electrical connective path to be established between the central contact post with a first signal-transmitting socket of the mono-signal connector and enabling contact to take place between the ground ring of the BNC connector and a ground socket contact of the mono-signal socket connector.

Although the above-described arrangement may provide for the establishment of a satisfactory electrical connection facilitating the transmission of the signal as required, the necessity for the interposition of an intermediate or interfacing adapter renders the overall signal-transmitting structure relatively complex in view of the need for the employment of an additional component or plurality of components. Generally, such a complex arrangement is undesirable from the standpoint of providing simplicity in the interconnection of the elements utilized in the appropriate transmission of signals from the coaxial cable connector, such as a female BNC coaxial cable connector receptacle to a single-signal or mono-signal socket connector.

2. Discussion of the Prior Art

Although various schemes and structures have been currently developed in the technology for connecting BNC coaxial cable connectors with other types of electrical connectors for the transmission of signals, most of these are directed to relatively complex arrangements which necessitate the provision of additional components to provide the desired interfacing connections, and considerable financial and manufacturing efforts and expenditures, while failing to provide for a generally satisfactory universally adaptable system for implementation of the transmission signal connection between a BNC coaxial cable connector and a single signal or mono-signal socket connector.

U.S. Pat. No. 5,137,469 to Carpenter et al. provides a hybrid connector for standard coaxial cable and other wiring systems, in which a BNC coaxial cable connector is adapted to be interconnected with a mono- or single-signal socket connector through the interposition of an interfacing adapter.

The adapter is designed to establish contact between the central contact post of the BNC coaxial cable connector and of a ground shield with, respectively electrical and ground contacts on the adapter. This type of electrical connector structure requires the interposition of an interfacing adapter in order to match up the different types of connectors, and renders the entire construction complex in nature, while uneconomically expensive to manufacture, and of a somewhat unreliable operative configuration.

U.S. Pat. No. 4,691,976 to Cowen discloses a coaxial cable tap connector in which a pair of spaced connector posts are adapted to contact a single-signal component for connecting a coaxial transmission line to a mono-signal connector. However, the construction of this particular coaxial cable tap connector is extremely complex, and of necessity requiring a multiplicity of components in order to enable the connection of a BNC coaxial cable connector to a single- or mono-signal connector.

U.S. Pat. No. 5,185,570 to Fitzpatrick discloses a BNC coaxial cable connector which is adapted to have a light emitting diode (LED) attached thereto, and is connectable to telecommunications equipment which is to be temporarily tested. There is no disclosure of implementing a direct connection between a BNC coaxial cable connector with a mono-signal socket connector.

Finally, U.S. Pat. No. 5,192,216 to Knauber et al. and U.S. Pat. No. 5,090,915 to Moulton each discloses various types of apparatus for grounding connectors to instrument chassis, and self-terminating coaxial tap connectors with external termination elements. In these instances, as well as in the previously-described patent publications, there is no disclosure of a simple arrangement for directly interconnecting a BNC coaxial cable connector with a mono-signal socket connector as is contemplated by the present invention.

SUMMARY OF THE INVENTION

Accordingly, pursuant to the present invention, there is disclosed the provision of a modified or essentially customized BNC coaxial cable connector, preferably a female receptacle connector, which is adapted to be directly connected to a single- or mono-signal socket connector which possesses a ground and a single signal socket connector terminal, without the need for the interposition of an interfacing adapter. The modified BNC coaxial cable connector has a central contact post in the configuration of a square cross-section in lieu of the normal BNC cable connector solder cup, and whereby a further in parallel spaced therewith contact post of similar square cross-section is added to the encompassing ground ring at a predetermined radial spacing to the central contact post, so as to enable insertion of the two square posts into the respective therewith operative associated socket contacts of the mono-signal socket connector. This, in essence, as mentioned hereinbefore, facilitates direct interconnection of a mono- or single-signal socket connector or the like, to a BNC coaxial cable connector without the need for an interfacing adapter, there reducing components and attendant costs while rendering the electrical connection highly reliable on its functioning.

It is an object of the present invention to provide a BNC coaxial cable connector which is modified so as to enable direct interconnection thereof with a mono-signal socket connector.

Another object of the present invention is to provide a BNC coaxial cable connector, preferably of the female receptacle type, which is customized so as to possess parallel extending signal and ground contact posts in order to enable the direct connection thereof with a single-signal or mono-signal socket connector in the absence of the need to provide for an interfacing adapter component.

BRIEF DESCRIPTION OF THE DRAWINGS

Reference may now be had to the following detailed description of a preferred embodiment of a modified customized BNC coaxial cable connector constructed in conformance with the concept of the invention, taken in conjunction with the accompanying drawings; in which.

DETAILED DESCRIPTION OF A PREFERRED EMBODIMENT

Figure 1:
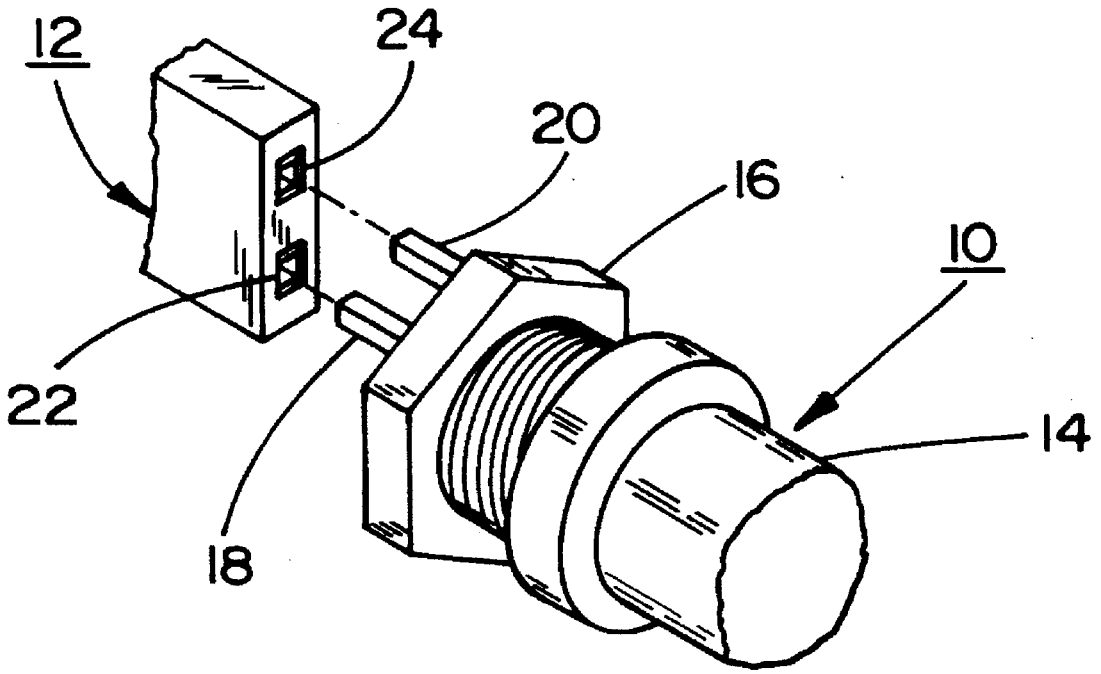
FIG. 1 illustrates a perspective exploded view of a modified BNC coaxial cable connector which is adapted to be directly connected to a mono-signal socket connector.

Referring now specifically to FIG. 1 of the drawings, there is illustrated, in a perspective representation, the modified BNC coaxial cable connector 10 as customized pursuant to the present invention, and which is adapted to be directly interconnected with a mono-signal socket connector 12 in the absence of having to employ an interfacing adapter (not shown). As is illustrated in the drawing, the BNC coaxial cable connector 10 includes a generally cylindrical body portion 14 having a hexagonal nut end section 16 from which there extends a pair of parallel spaced elongate contact posts 18 and 20, each being square in transverse cross-section, with the post 18 being a communication transmitting or signal-conducting contact post adapted to engage into a signal transmitting socket connection 22 which is located in the mono-signal socket connector 12; whereas the contact post 20 is a grounded element adapted to engage into a ground socket connection 24 in the mono-signal socket connector 12.

Figure 3:
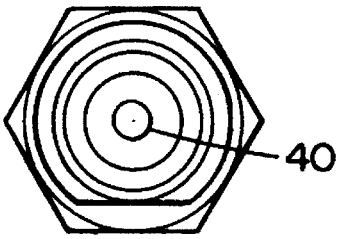
FIG.3 (PRIOR ART)
FIG. 3 illustrates an end view of the BNC coaxial connector of FIG. 2.
Figure 2:
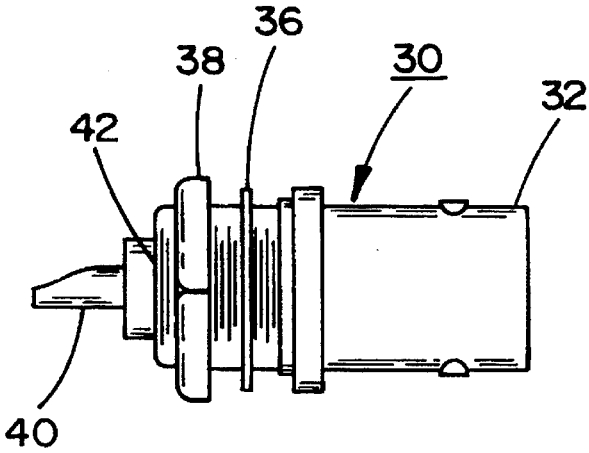
FIG.2 (PRIOR ART)
FIG. 2 illustrates a side view of a standard female BNC coaxial cable connector which is constructed pursuant to the current state of the art.

As is represented in FIGS. 2 and 3 of the drawings, showing a typical or standard state-of-the-art female BNC coaxial cable receptacle connector 30 which includes a cylindrical body or housing portion 32, a threaded portion 34 on which there is located a jam-nut and washer 36, and the front end of which includes a hexagon jam-nut 38. Projecting centrally forwardly from the BNC coaxial cable connector is a cylindrical solder cup 40, while a ground ring 42 extends about the forward end portion ahead of the hexagonal nut 38 on the BNC coaxial cable connector 30.

Figure 6:
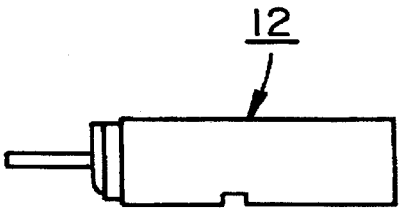
FIG. 6 illustrates a side view of a mono-signal socket connector which is adapted to be interconnected with the BNC coaxial cable connector of FIG. 4.
Figure 7:
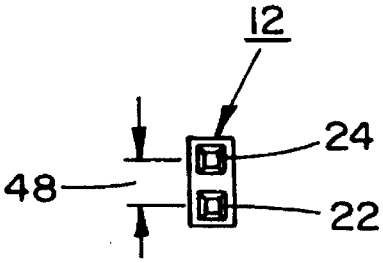
FIG. 7 illustrates an end view of the mono-signal socket connector of FIG. 6.

In order for the BNC coaxial cable connector 30 of FIG. 2 to be able to be connected to a mono-signal socket connector 12, which may be of the type as shown in detail in FIGS. 6 and 7 of the drawings, an interfacing adapter (not shown) must be ordinarily provided so as to enable a grounded plug or contact pin connector to enter into the ground socket 24 and a signal-transmitting pin connector of the adapter to be able to enter into the socket 22 of the mono-signal socket connector 12, the sockets 22, 24 each being of generally square configuration, in this instance, preferably of 0.025 inches square.

Figure 5:
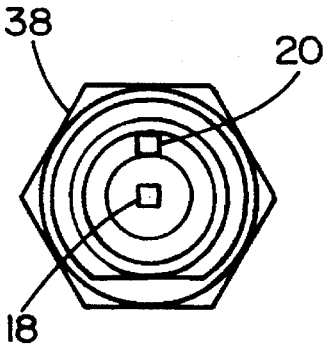
FIG. 5 illustrates an end view of the BNC coaxial cable connector of FIG. 4.
Figure 4:
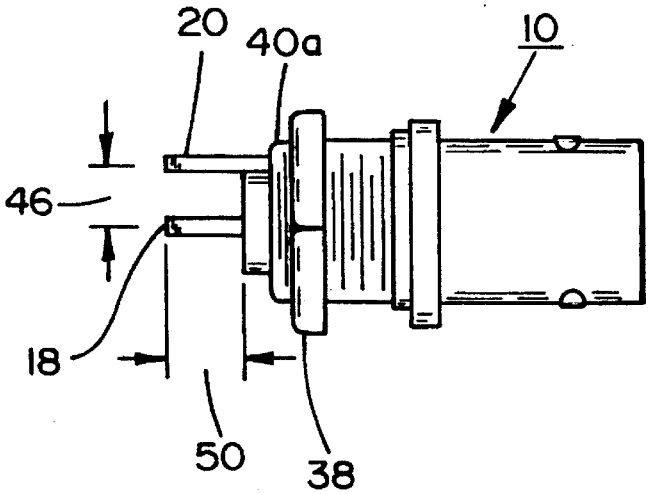
FIG. 4 illustrates a side view of the modified BNC coaxial cable connector pursuant to the invention as shown in FIG. 1.

In order to obviate the necessity for the provision and positioning of any interfacing adapter between the mono-signal socket connector 12 and a BNC coaxial cable connector, as would be the case for the connector 30, the latter is inventively modified or customized so as to be constructed as shown in FIGS. 4 and 5 of the drawings, and identified by reference numeral 10, referring also to FIG. 1 of the drawings. In this instance, elements or connector components which are identical with or similar to those of the BNC coaxial cable connector 30 of FIGS. 2 and 3 are identified by the same reference numerals.

In lieu of the solder cup terminal 40, in the modified connector 10 there is provided an elongate central contact post or pin 18 which possesses a square transverse cross-sectional configuration, and which is adapted to be inserted into and received in the square-shaped signal-transmitting socket terminal 22 in the single-signal or mono-signal socket connector 12.

Projecting in specified parallel spaced coextensive relationship with the signal-transmitting contact post or pin 18 is the elongate post or pin 20 which is of a similar square transverse cross-sectional configuration, each post 18, 20 having a cross-sectional size of about 0.025 inches square, and which is fastened or conductively soldered to a front surface **40*a* on the outer ground ring 40 of the BNC coaxial cable connector 10. The spacing between the parallel-extending longitudinal axes of the posts or pins 18 and 20 is identified by reference numeral 46. In this particular instance, the spacing 46 between the axes of posts 18, 20 may be 0.100 inches, in conformance with the similar spacing 48 between the respective signal-transmitting and ground socket terminals 22, 24 in the mono-signal socket connector 12. Consequently, this will facilitate effectuating a direct operative interconnection between the posts or pins 18, 20 of the modified BNC coaxial cable connector 10 and the socket terminal connections 22, 24 in a mono-signal socket connector 12. The latter connector 12 may be of the type commercially sold under the registered trademark "Mono-Signal Socket Connector TLA" by the 3M Corporation (Minnesota Mining & Manufacturing Co.), Series 100, although other similar single-signal connectors may also be contemplated as being directly connectable to the connector 10**.

Although, under ordinary instances the length of the central contact post or pin 18 as identified by reference numeral 50 in FIG. 4 may be about 0.200 inches, with the ground contact post 20 being coextensive therewith in length, it is also possible to contemplate imparting increased lengths to each of the posts 18, 20 so as to provide them with an overall length of about 0.500 inches, which will enable the connector to be wire-wrapped, as is known in the technology.

From the foregoing description, it becomes readily apparent that the modified or customized pin BNC coaxial cable connector 10 is of a simple construction facilitating the direct interconnection with a single-signal or mono-signal socket connector; for example, of the type identified by reference numeral 12 and as shown in FIGS. 6 and 7 of the drawings, without necessitating extensive engineering changes and at a minimum economic expenditure, while concurrently eliminating the need for interfacing adapters so as to render the entire construction and functioning highly reliable in nature and in conformance with the most rigorous industry standards and requirements.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A pin BNC coaxial cable connector which is adapted for direct interconnection with a mono-signal socket connector having first and second socket terminals; said BNC coaxial cable connector comprising a receptacle body; a first contact post member and a second contact post member each respectively having a square transverse cross-sectional configuration and each projecting from an end of said receptacle body, said second contact post member extending in parallel spaced relationship with said first contact post member to enable conductive reception of said first and second contact post members in, respectively, the first and second socket terminals of the mono-signal socket connector; said first contact post member comprising a center pin projecting from the receptacle body; a ground ring on said receptacle body, said second contact post member being a pin projecting from and conductively fastened to said ground ring.

2. A pin BNC coaxial cable connector as claimed in claim 1, wherein said first contact post member is adapted to form a signal connection with the first socket terminal and said second contact post member is adapted to form a grounded connection with the second socket terminal.

3. A pin BNC coaxial cable connector as claimed in claim 1, wherein said square transverse cross-sectional dimensions of each said contact post members are of a size of 0.025 inches square.

4. A pin BNC coaxial cable connector as claimed in claim 1, wherein the spacing between the longitudinal axes of said first and second contact post members comprises 0.100 inches.

5. A pin BNC coaxial cable connector as claimed in claim 1, wherein said first and second contact post members each have a length of approximately 0.200 inches.

6. A pin BNC coaxial cable connector as claimed in claim 1, wherein said first and second contact post members each have a length of approximately 0.500 inches to facilitate wire-wrapping of said contact post members.

7. A pin BNC coaxial cable connector as claimed in claim 1, wherein said second contact post member is soldered to said ground ring.

8. A modified BNC coaxial cable connector incorporating structure for the direct interconnection thereof with a mono-signal socket connector having first and second socket terminals; said BNC coaxial cable connector comprising a cylindrical receptacle member; a first contact pin projecting centrally from one end of said cylindrical receptacle member; and a second contact pin arranged on said cylindrical receptacle member in parallel spaced relationship and being coextensive with said first contact pin, each of said contact pins having a square transverse cross-sectional configuration, said first contact pin comprising a center post of said BNC coaxial cable connector; a ground ring on said receptacle member, said second contact pin being conductively fastened to said ground ring, whereby said first and second contact pins are conductively receivable in, respectively, the first and second socket terminals of the mono-signal socket connector.

9. A modified BNC coaxial cable connector as claimed in claim 8, wherein said first contact pin is adapted to produce a signal connection with the first socket terminal, and said second contact pin is adapted to provide a grounded connection with the second socket terminal.

10. A modified BNC coaxial cable connector as claimed in claim 8, wherein said square transverse cross-sectional pin dimensions are 0.025 inches square.

11. A modified BNC coaxial cable connector as claimed in claim 8, wherein the spacing between the longitudinal axes of said first and second contact pins comprises 0.100 inches.

12. A modified BNC coaxial cable connector as claimed in claim 8, wherein said first and second contact pins each have a length of approximately 0.200 inches.

13. A modified BNC coaxial cable connector as claimed in claim 8, wherein said first and second contact pins each have a length of approximately 0.500 inches to facilitate wire-wrapping of said contact pins.

14. A modified BNC coaxial cable connector as claimed in claim 8, wherein said second contact pin is soldered to said ground ring.

* * * * *